United States Patent [19]

Juda et al.

[11] 3,951,833

[45] Apr. 20, 1976

[54] METHOD FOR PRESERVING FUNCTIONAL FLUIDS AND LIQUID HYDROCARBON FUELS WITH SELECTED 1,10-PHENANTHROLINES

[75] Inventors: Robert H. Juda, Orange; Gene A. Hyde, Hamden; Alan E. Ardis, North Haven, all of Conn.

[73] Assignee: Olin Corporation, New Haven, Conn.

[22] Filed: Feb. 27, 1975

[21] Appl. No.: 553,705

[52] U.S. Cl. ..... 252/51.5 R; 44/63; 72/42; 252/50; 252/51; 252/77; 252/401; 252/403

[51] Int. Cl.[2] ..... C10M 1/32; C10M 3/26; C10M 5/20; C10M 7/30

[58] Field of Search ..... 44/63; 252/50, 51, 51.5 R, 252/401, 403, 77; 72/42

[56] References Cited

UNITED STATES PATENTS

| | | | |
|---|---|---|---|
| 3,228,829 | 1/1966 | Wolf et al. | 252/51 |
| 3,692,677 | 9/1972 | Stanton et al. | 252/51.5 R |
| 3,714,046 | 1/1973 | Adams et al. | 252/51 |

FOREIGN PATENTS OR APPLICATIONS

| | | | |
|---|---|---|---|
| 1,236,087 | 6/1971 | United Kingdom | 252/50 |

*Primary Examiner*—Delbert E. Gantz
*Assistant Examiner*—I. Vaughn
*Attorney, Agent, or Firm*—Robert L. Andersen

[57] ABSTRACT

A method for preserving certain organic fluids is provided wherein an inhibitory amount of a selected 1,10-phenanthroline is incorporated in such fluids as a biocide.

10 Claims, No Drawings

METHOD FOR PRESERVING FUNCTIONAL FLUIDS AND LIQUID HYDROCARBON FUELS WITH SELECTED 1,10-PHENANTHROLINES

BACKGROUND OF THE INVENTION

The present invention relates to preservatives for certain organic fluids which are prone to microbial degradation or contamination during use or storage.

The fluids referred to are those which are or become, under conditions of use or storage, a mixture of an organic component and a water component wherein the water is either dissolved in the organic component or vice versa or where water forms an oil/water interface with the organic component, and which supports and promotes microbial growth leading to contamination and/or degradation of the fluid. More particularly the invention is useful in at least 2 types of fluids: functional fluids and liquid hydrocarbon fuels.

As used herein the term "functional fluid" refers to fluids such as hydraulic fluid, brake fluid, and metal working fluids, such as cutting fluids. The liquid hydrocarbon fuels include diesel fluid, jet fuel, general aviation fuel, and heating oil. For purposes of simplicity the present invention is defined with particular reference to metal working fluids, but is understood to be applicable to the other functional fluids and fuels unless a contrary intent is specifically set forth herein.

The term "metal working fluids" as used herein are those fluids discussed in "Metal Working Lubricants", E. L. H. Bastian, McGraw Hill Co., 1951, pp. 5–56, which will support microbial growth under conditions of normal use. For purposes of convenience these fluids may be divided into two types, the straight oils and the so-called water soluble fluids. Straight oils are basically a petroleum oil, with or without additives. The principle component may be a naphthenic or paraffinic oil. The straight oils are not miscible with water and thus, when exposed to moisture during use or storage, form an interface therewith which supports growth of microorganisms. The water soluble fluids may be subdivided into at least three major types including Chemical Fluids, Emulsions, and Semi-Chemical Fluids as described in *CUTTING AND GRINDING FLUIDS: Selection and Application*, American Society of Tool and Manufacturing Engineers, Dearborn, Michigan, 1967, pp. 1–4.

Chemical Fluids, also known as "Synthetic Fluids", are those which do not form emulsions when diluted for use, which may or may not contain surfactants, and which contain no mineral oil or other water insoluble lubricant component.

Emulsions, also known as "Water Miscible Fluids", "Water Soluble Oils", or "Soluble Oils", are emulsions of oil droplets (mineral, paraffinic or naphthalenic) in water. These fluids generally contain 50 to 75% oil with the balance being emulsifiers, additives, coupling agents, corrosion inhibitors, etc. The emulsifiers may be, for example, petroleum sulfonates, amine soaps, rosin soaps, naphthenic acids, etc. Coupling agents may be, for example, complex alcohols or nonionic surfactants, etc. Particle size of the oil droplets is at least $0.1\mu$ and is generally $2–5\mu$ when diluted for use.

Semi-Chemical Fluids, also known as "Semi-Synthetic Fluids", contain less oil than emulsions, generally 10 to 45%, higher amounts of emulsifiers and additives and up to about 20% water. Particle size of the oil droplets is generally in the range of $0.1\mu$ to 1.0 $m\mu$ when diluted for use.

Any of these fluid types may contain active sulfur, phosphorus and chlorine compounds to increase efficiency under severe machining conditions. These additives are called Extreme Pressure (E.P.) additives and may take the form of sulfurized fat, chlorinated paraffin, phosphates or the like.

These metal working fluids when mixed with water are used commercially in large quantities to reduce friction in metal working operations such as cutting, threading, grinding, polishing and the like, and to dissipate heat generated as a result thereof. Since large quantities are employed, it is desirable to reuse the fluids as long as possible. In this regard one of the major problems for users of these fluids has been preventing microbial contamination and/or degradation upon continued use.

Manufacturers and others have explored numerous biocides for use in metal working fluids and many of these are reported in the patent literature. Of those which are commercially available, the following are commonly used:

1. MILIDIN TI-10, DeMille Chemical Co., believed to comprise about 93% hydroiodide salt of mixed ethylene diamine monoethylene glycol ether;
2. GROTAN, Lehn & Fink, 78.5% Hexahydro-1,3,5,tris-(2-hydroxyethyl)-triazine;
3. VANCIDE-TH, R. T. Vanderbilt Co., Hexahydro-1,3,5-triethyl-triazine.

While these exhibit a certain degree of efficacy in metal working fluids, they lose their ability to protect against growth of offending organisms after a limited period of time.

On the other hand, a desirable biocide for protecting these fluids against microbial attack should preserve the fluid over extended periods of time. It should also be compatible with a large majority of the fluids which are presently in commercial use and should prevent the dermatitis which frequently occurs due to handling of or exposure to contaminated fluids.

Because of the great diversity of additives found in commercially available metal working fluids, it is clearly impossible to find a universal preservative which will be effective for all such fluids. We have found, however, that selected 1,10-phenanthrolines are surprisingly effective in preventing microbial contamination of many such fluids over extended periods of time.

1,10-Phenanthrolines are known and commercially available. They are usually prepared by a Skraup reaction or a modified or related Skraup reaction which involves heating a primary aromatic amine having at least one unsubstituted ortho position with glycerol, sulfuric acid and an oxidizing agent. If the aromatic amine is a monoamine, the resultant compound is a substituted quinoline which may then be further reacted to form the phenanthroline. The reaction of an aromatic diamine such as 3,4-tolylene diamine with 2 moles of glycerol also yields 1,10-phenanthroline substituted in the 5 position.

Another method of preparing 1,10-phenanthrolines is to first prepare 8-amino-quinoline and then react this under Skraup reaction condition as indicated above. These methods and various modifications thereof for manufacturing 1,10-phenanthrolines are more completely discussed and set forth in U.S. Pat. No. 3,389,143 which is incorporated herein by reference insofar as it is relevant to the manufacture and purification of 1,10-phenanthrolines.

It is also known that phenanthrolines, including various 1,10-phenanthrolines exhibit varying degrees of microbiological activity. These compounds have not previously been employed as preservatives in organic fluids. We have found that certain of the 1,10-phenanthrolines are remarkably effective in this application.

DESCRIPTION OF THE INVENTION

This invention comprises a method for preventing microbial contamination of organic fluids particularly functional fluids and liquid hydrocarbon fuels, by incorporating therein an effective inhibitory amount of a biocide comprising selected 1,10-phenanthroline derivatives which are herein described. In a second embodiment, the invention comprises a cutting or metal working fluid preserved with the selected 1,10-phenanthroline derivatives.

The biocides useful for inhibiting the growth of microorganisms in, and thus for preventing microbial contamination or degradation of functional fluids and liquid hydrocarbon fuels comprise a 1,10-phenanthroline derivative having the general formula:

(I)

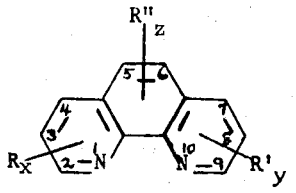

wherein R and R′ are each hydrogen or lower alkyl groups having 1–4 carbon atoms, preferably methyl, substituted at positions 2,3,4,7,8,9 wherein R″ is a substituent at position 5,6 or both selected from the group consisting of hydrogen, lower alkyl having 1–4 carbon atoms (preferably methyl), phenyl, halo, nitro and oxy (keto).

The letters $x$ and $y$ each correspond to integers, zero or positive, in the range of 0–2 representing the number of alkyl substituents on carbon atoms of each of the heteroaromatic (nitrogen containing) rings. The sum of the integers represented by $x$ and $y$, i.e. the value of $x$ plus $y$, is an integer in the range of 0–4. The letter $z$ is an integer, also zero or positive, having a value in the range of 0–2 representing the number of R″ groups, other than hydrogen, substituted at positions 5,6 or both. The sum of the integers represented by letters $x$, $y$ and $z$ is an integer, zero or positive, having a value in the range of 0–4 representing the total number of substituents other than hydrogen on the 1,10-phenanthroline nucleus.

Throughout the specification, it is understood that whenever $x$ or $y$ is less than 3 or $z$ is less than 2 the respective difference represents hydrogen substituents appended to ring carbon atoms. It is also specifically noted and provided that where R″ is oxy (keto) and $z$ is 2, i.e. a phenanthroline-5,6-dione, the bond bridging positions 5 and 6 is saturated rather than unsaturated as shown in the preceding formula. Thus, the formula would appear as in formula II:

(II)

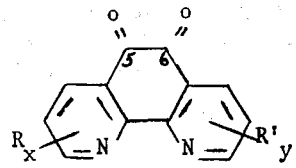

For convenience, the biocides useful for preventing microbial contamination or degradation of functional fluids and liquid hydrocarbon fuels can be divided into three groups based on the value of $z$. In the first group, $z$ is zero so that the 5 and/or 6 positions (which are of course equivalent due to the symmetry of the molecule) of the 1,10-phenanthroline nucleus are occupied only by hydrogen. Representative compounds include for example 1,10-phenanthroline, 2,9-dimethyl-1,10-phenanthroline, 4,7-dimethyl-1,10-phenanthroline, and 3,4,7,8-tetramethyl-1,10-phenanthroline or their hydrates.

The second group of compounds useful for preserving metal working fluids are those 1,10-phenanthrolines where $z$ is 1. In this group only one R″ substituent is present at either position 5 or 6, the other being hydrogen. Representative examples of this group include 5-methyl-1,10-phenanthroline, 2,5,9-trimethyl-1,10-phenanthroline, 5-nitro-1,10-phenanthroline, 5-phenyl-1,10-phenanthroline, 5-halo-(preferably chloro)-1,10-phenanthroline and their hydrates. Thus, when $z$ is 1, R″ may be a lower alkyl having 1–4 carbons, preferably methyl, nitro, phenyl, oxy, or halo. Suitable halo substituents include chlorine, bromine, fluorine, and iodine, preferably chlorine. 5-methyl-1,10-Phenanthroline is one of the preferred compounds of this group.

The third group of compounds useful in accordance with the present invention are those 1,10-phenanthroline wherein $z$ is 2, i.e. both the 5 and 6 positions are substituted. This group includes for example 5,6-dimethyl-1,10-phenanthroline and its monohydrate, and 1,10-phenanthroline-5,6-dione. Thus, when $z$ is 2, R″ may be for example a 5,6-dione or a 5,6-dialkyl-1,10-phenanthroline in which the 5,6-alkyl substituents are advantageously lower alkyls having 1–4 carbons, preferably methyl. Where the 5 and 6 positions are both substituted with oxy (keto) groups, the unsaturation bridging positions 5 and 6 disappers as indicated above and shown in formula II.

Metal working fluids, for example cutting fluid, are generally marketed as a concentrate which is diluted with water to a use dilution having a volume generally in the range of 5 to 100 times that of the concentrate. With respect to fluids intended for dilution, the invention may be practiced by incorporating into the concentrate an amount of the selected 1,10-phenanthroline to provide at least an inhibitory amount in the use dilution or by incorporating an inhibitory amount of biocide directly into the diluted mixture.

With respect to the preservation of other functional fluids and liquid hydrocarbon fuels, these are generally supplied in ready to use form. The problem of contamination generally arises because these fluids are stored under conditions which permit the accumulation of moisture in storage tanks or transfer lines, thus permitting an oil/water interface to develop which will support microbial growth. This growth then tends to plug jets, filters and in some instances the lines themselves. This problem is readily prevented by incorporating in the fluid an inhibitory amount of the biocides of the present invention.

With respect to the liquid hydrocarbon fuels, such as diesel fuel for shipboard use, jet fuel on carriers and heating oil which is carried on tankers, water is used as a ballast in partially empty tanks. Such organisms as Cladosporium resinae grow at the oil/water interface and form slimes which plug filters and equipment unless removed. Incorporating an inhibitory amount of the biocide of the present invention avoids the need for slime removal.

While the minimum inhibitory concentration for each of the above-identified biocides varies somewhat, a diluted concentration in the range of 100 ppm to 1500 ppm is desirable, preferably 200 ppm to 1000 ppm. This range represents a suitable concentration range for the biocide to be effective in what has been termed the use dilution. If the biocide is to be incorporated into a concentrate, the level actually utilized in the concentrate must be increased to reflect the dilution factor. For example a cutting fluid which is to be diluted 40:1 having a biocide active at 500 ppm in the use dilution would require a level of 2% in the concentrate. The upper limit of concentration, of course, is purely dictated by economic considerations.

Having thus described the present invention, the examples below demonstrate the surprising efficacy of selected 1,10-phenanthrolines in comparison with prior art preservatives. Two test methods have been employed as hereinafter described.

TEST METHOD 1

Selected biocides were added in measured amounts to various unpreserved cutting fluids. The biocide/cutting fluid mixture was then diluted by adding 10 cc thereof to 400 cc of water in a 500 cc beaker. One heaping teaspoonful of corn meal and 10 g of cast iron chips were added. The mixtures were each inoculated with 10 cc of an innoculant containing about $2.5 \times 10^9$ organisms per cc taken from a microbially contaminated cutting fluid comprising members of the genera Pseudomonas, Salmonella, Saccharomyces, Bacillus, and least 2 species of molds. A 1.5 cm square of slime from the culture was also added. The mixture was incubated for one week at 35°C. in the open beaker. The mixture was then reinoculated as above, water added to replace that which had evaporated, the vessels covered with a Petri dish, and the resulting mixture incubated at 24°C. until growth occurred.

If no noticeable change occurred within four weeks after inoculation, the inhibitory action is deemed commercially acceptable. If a failure is noted prior to four weeks, the inhibitory action is unacceptable. Criteria for determination of failure include development of any of the following conditions:

1. Development of an unpleasant odor over the beaker, i.e., musty, sour mash, or putrid.
2. Development of slime colonies or slime layer on surface.
3. Heavy fermentation of corn meal as evidenced by evolution of gas.
4. pH drop to below 5.0.

The numbers utilized herein are used in the accompanying examples to designate the mode(s) of failure.

TEST METHOD 2

Minimal Inhibitory Concentration (MIC) for various organisms

The antimicrobial evaluation of the test material was accomplished by means of a modification of the Standard Broth Inhibition test method. The procedure employed involves the use of the Autotiter IV (Canalco, Inc. Rockville, Maryland), an instrument which automatically serially dilutes a test material in appropriate broth culture media and inoculates the diluted samples with the individual test organisms. Concentrations of each test material ranging from 1000 ppm to 0.25 ppm were arrived at by means of a series of two-fold dilutions. The diluted samples were inoculated with 24-hour broth cultures of the test bacteria, with 7–14 days aqueous spore suspensions of the test fungi. The inoculated, diluted samples were incubated as follows: Bacteria for 72 hours at 37°C, fungi for 7–10 days at 28°C. Following incubation, the samples were examined for the presence or absence of microscopic growth. The lowest concentration of a test material which inhibits the growth of a given population of organisms is designated the "Minimal Inhibitory Concentration" which was reported in parts per million (ppm).

The organisms against which the test materials were tested include:

Bacteria
- *Staphylococcus aureus*
- *Sarcina lutea*
- *Streptococcus faecalis*
- *Bacillus cereus*
- *Escherichia coli*
- *Salmonella typhimurium*
- *Pseudomonas aeruginosa*
- *Proteus vulgaris*

Molds
- *Aspergillus niger*
- *Pullularia pullulans*
- *Penicillium vermiculatum*
- *Cladosporium resinae*
- *Trichophyton mentagrophytes*
- *Fusarium semitectum*

Yeasts
- *Candida albicans*
- *Saccharomyces cerevisiae*

EXAMPLE 1

The cutting fluid VANTROL - 255 A, Van Straaten Co., Chicago, Illinois, a soluble oil type cutting fluid was tested according to Test Method 1 with 5-methyl-1,10-phenanthroline and with various other cutting fluid biocides including: MILIDIN TI-10, GROTAN and VANCIDE-TH.

The results of these test are reported in Table I.

TABLE I

| BIOCIDE | CONCENTRATION (ppm in use dilution) | WEEKS TO FAILURE | MODE OF** FAILURE |
|---|---|---|---|
| MILIDIN TI-10 | 500 | 1 | 1,2,3 |
| GROTAN | 500 | 1 | 1,2,3 |
| GROTAN | 1500 | 2 | 2 |
| VANCIDE-TII | 500 | 2 | 2 |
| 5-MP | 500 | 52* | — |

*Indicates no failure after specified number of weeks.
**See Test Method 1.

EXAMPLE 2

Example 1 was repeated using VANTROL - 550, Van Straaten Co., Chicago, Illinois, a semi-synthetic type cutting fluid. The results are reported in Table II.

TABLE II

| BIOCIDE | CONCENTRATION (ppm in use dilution) | WEEKS TO FAILURE | MODE OF** FAILURE |
|---|---|---|---|
| MILIDIN TI-10 | 500 | 0.5 | 1,2 |
| GROTAN | 500 | 1 | 1,2 |
| GROTAN | 1500 | 2 | 1,2 |
| VANCIDE-TH | 500 | 2 | 2 |
| 5-MP | 250 | 52* | — |

*No failure after specified number of weeks
**See Test Method I.

EXAMPLE 3

Example 1 was repeated using VANTROL - 711, Van Straaten Co., Chicago. Illinois, a high performance soluble oil cutting fluid. The results are reported in Table III.

TABLE III

| BIOCIDE | CONCENTRATION (ppm in use dilution) | WEEKS TO FAILURE | MODE OF* Failure |
|---|---|---|---|
| MILIDIN TI-10 | 500 | 0.5 | 1,2,3 |
| GROTAN | 500 | 2 | 1,2,3 |
| GROTAN | 1500 | 2 | 2 |

TABLE III-continued

| BIOCIDE | CONCENTRATION (ppm in use dilution) | WEEKS TO FAILURE | MODE OF* Failure |
|---|---|---|---|
| VANCIDE-TH | 500 | 2 | 1,2 |
| 5-MP | 500 | 19 | 1,2 |

*See Test Method I

EXAMPLES 4–15

Additional cutting fluids were tested according to Test Method I with 5-methyl-1,10-phenanthroline. Results are reported in Table IV.

TABLE IV

| EXAMPLE | CUTTING FLUID | TYPE* | 5-MP CONC. (ppm in use dilution) | WEEKS TO FAILURE | MODE OF FAILURE |
|---|---|---|---|---|---|
| 4 | WHEELMATE XLG-81-6 (Norton) | SS | 500 | 25** | — |
| 5 | ASHLAND SOLUBLE OIL | SO | 500 | 1 | 1,3,4 |
| 6 | CIMCOOL 15-QC-1 (Cincinnati Milicron) | SS | 500 | 3 | 1,2 |
| 7 | METALUB TS-3291 (Metal Lubricants Co.) | SO | 500 | — | Emulsion Split |
| 8 | HOUGHTON CUTTING Fluid 527-72A | SO | 500 | 11 | 1 |
| 9 | TEXACO SOLUBLE OIL C | SO | 500 | 7.5 | 1,2 |
| 10 | No. 3776 SOLUBLE OIL (Humble Oil Co.) | SO | 500 | 6 | 1,2 |
| 11 | CITGO CUTTING Oil 205 | SO | 500 | — | Emulsion Split |
| 12 | SUNOCO EMULSIFYING CUTTING OIL | SO | 500 | 1 | 1,3,4 |
| 13 | GULF CUT SOLUBLE Oil | SO | 500 | — | Emulsion Split |
| 14 | METALUB TS-2776M (Metal Lubricants Co.) | SS | 500 | 32** | — |
| 15 | METALUB TS-3480 (Metal Lubricants Co.) | S | 500 | 32** | — |

*SS = Semi-Synthetic; SO = Soluble Oil; S = Synthetic.
**No failure after weeks specified.

EXAMPLES 16–39

The biocides utilized in the preceding examples and varous phenanthrolines were subjected to microbiological screening according to Test Method 2 above. A numerical rating based on a scale of 1–16 was assigned the test biocide according to its activity (minimum inhibitory concentration) against each organism tested. The numerical ratings were then added together to provide an overall activity score which is reported below. A score of 86 indicates that the test compound was effective at ½ the level of one having a score of 70; one having a score of 102 was effective at ½ the level of one having a score of 86. Those compounds exhibiting a score of 86 or more are regarded as acceptable biocides for the present fluids. Those having a score of 100 or more are considered superior biocides for such fluids. The results are reported in Table V.

TABLE V

| EXAMPLE | BIOCIDE | ACTIVITY SCORE |
|---|---|---|
| 16 | GROTAN | 70 |
| 17 | VANCIDE-TH | 80 |
| 18 | MILIDIN TI-10 | 66 |
| 19 | 1,10-phenanthroline | 110 |
| 20 | 1,7-phenanthroline | 70 |
| 21 | 4,7-phenanthroline | 58 |
| 22 | 2,9-dimethyl-1,10-phenanthroline | 107 |
| 23 | 3,4,7,8-tetramethyl-1,10-phenanthroline | 105 |
| 24 | 4,7-dimethyl-1,10-phenanthroline.$H_2O$ | 148 |
| 25 | 4,7-dihydroxy-1,10-phenanthroline.HCl | 35 |
| 26 | 4,7-diphenyl-1,10-phenanthroline | 48 |
| 27 | 2,9-dimethyl-4,7-diphenyl-1,10-phenanthroline | 32 |

TABLE V-continued

| EXAMPLE | BIOCIDE | ACTIVITY SCORE |
|---|---|---|
| 28 | 5-methyl-1,10-phenanthroline | 100 |
| 29 | 2,5,9-trimethyl-1,10-phenanthroline | 147 |
| 30 | 5-nitro-1,10-phenanthroline | 86 |
| 31 | 5-phenyl-1,10-phenanthroline | 161 |
| 32 | 5-chloro-1,10-phenanthroline | 150 |
| 33 | 5-methyl-1,10-phenanthroline.$ZnCl_2.H_2O$ | 80 |
| 34 | 5-methyl-1,10-phenanthroline.$H_2O$ | 117 |
| 35 | 5,6-dimethyl-1,10-phenanthroline.$H_2O$ | 118 |
| 36 | 1,10-phenanthroline-5,6-dione | 140 |
| 37 | 5-methyl-phenanthroline-1-oxide | 39 |

I claim:

1. A method for preventing microbial contamination of organic fluids selected from the group consisting of functional fluids and liquid hydrocarbon fuels which support microbial growth when mixed with water comprising incorporating in said fluid an effective inhibitory amount of a biocide having the formula

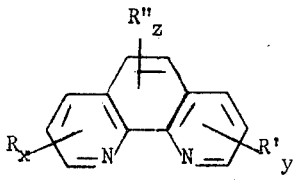

wherein R and R′ are lower alkyl appended to a ring carbon atom, $x$ and $y$ are each integers in the range of 0–2, the sum of $x$ and $y$ being an integer in the range of 0–4 and wherein R″ is selected from the group consisting of lower alkyl, phenyl, halo, nitro and oxy, $z$ being an integer in the range of 0–2 and wherein the sum of $x$, $y$, and $z$ is an integer in the range of 0–4.

2. The method of claim 1 wherein said organic fluid is a metal working fluid.

3. The method of claim 1 wherein said organic fluid is a cutting fluid.

4. The method of claim 1 wherein $z$ is an integer having a value of 1.

5. The method of claim 1 wherein said biocide is 5-methyl-1,10-phenanthroline.

6. The method of claim 1 wherein said organic fluid is a cutting fluid and said biocide is 5-methyl-1,10-phenanthroline.

7. A metal working fluid having incorporated therein an effective inhibitory amount of a biocide having the formula

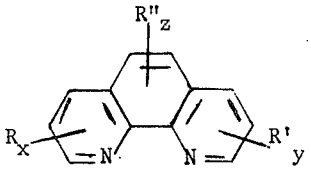

wherein R and R′ are methyl, $x$ and $y$ are each integers in the range of 0–2, the sum of $x$ and $y$ being an integer in the range of 0–4 and wherein R″ is selected from the group consisting of methyl, phenyl, halo, nitro and oxy, $z$ being an integer in the range of 0–2 and wherein the sum of $x$, $y$, and $z$ is an integer in the range of 0–4.

8. The metal working fluid of claim 7 wherein $z$ is an integer whose value is 1.

9. The metal working fluid of claim 7 wherein said biocide is 5-methyl-1,10-phenanthroline.

10. The metal working fluid of claim 7 wherein said fluid is a cutting fluid and said biocide is 5-methyl-1,10-phenanthroline.

* * * * *